US005772526A

United States Patent [19]

Hano

[11] Patent Number: 5,772,526

[45] Date of Patent: Jun. 30, 1998

[54] GOLF CLUB HEADS

[75] Inventor: Naoto Hano, Chiba-ken, Japan

[73] Assignee: Maruman Golf Kabushikikaisha, Tokyo, Japan

[21] Appl. No.: 743,112

[22] Filed: Dec. 30, 1992

Related U.S. Application Data

[63] Continuation of Ser. No. 552,628, Jul. 16, 1990, abandoned.

[30] Foreign Application Priority Data

Jul. 17, 1989 [JP] Japan ..... 1-182436

[51] Int. Cl.[6] ..... A63B 53/04

[52] U.S. Cl. ..... 473/314; 473/349

[58] Field of Search ..... 473/305, 306, 473/307, 308, 309, 310, 311, 312, 313, 314, 315, 327, 328, 334, 349, 350, 246, 247, 248

[56] References Cited

U.S. PATENT DOCUMENTS

| | | | |
|---|---|---|---|
| 835,735 | 11/1906 | Robertson | 273/167 F |
| 1,982,087 | 11/1934 | Wantz | 473/247 |
| 2,691,525 | 10/1954 | Callaghan, Sr. | 473/247 |
| 2,960,338 | 11/1960 | Havey et al. | 473/314 |
| 3,595,577 | 7/1971 | Hodge | 273/80 C |
| 3,625,518 | 12/1971 | Solheim | 273/175 |
| 3,693,978 | 9/1972 | East | 473/314 |
| 3,791,647 | 2/1974 | Verderber | 473/247 |
| 3,897,065 | 7/1975 | Solheim | 273/167 A |
| 4,027,885 | 6/1977 | Rogers | 273/169 |
| 4,200,286 | 4/1980 | Bennett . | |
| 4,512,577 | 4/1985 | Solheim | 273/77 A |
| 5,094,457 | 3/1992 | Kinoshita | 473/314 |
| 5,643,104 | 7/1997 | Antonious . | |

FOREIGN PATENT DOCUMENTS

| | | | |
|---|---|---|---|
| 42-16245 | 9/1942 | Japan . | |
| 50-64039 | 5/1975 | Japan . | |
| 53-51253 | 12/1978 | Japan . | |
| 1-501124 | 4/1989 | Japan . | |
| 371974 | 5/1932 | United Kingdom | 273/167 F |
| 1 362 432 | 8/1974 | United Kingdom . | |
| 1 508 190 | 4/1978 | United Kingdom . | |
| 2 126 486 | 3/1984 | United Kingdom . | |
| 2 200 558 | 2/1987 | United Kingdom . | |
| 2192795 | 1/1988 | United Kingdom | 273/167 R |
| 2 206 284 | 1/1989 | United Kingdom . | |

OTHER PUBLICATIONS

"Golf Digest", Inverted Mallet, May 1974, p. 157.

"Golf Digest," Browning 440 Woods and Irons, May 1977, p. 84.

*Primary Examiner*—Steven B. Wong

*Attorney, Agent, or Firm*—Armstrong, Westerman, Hattori, McLeland & Naughton

[57] ABSTRACT

This invention provides golf club heads wherein a distance between the point of gravity center (O) of a head and the longitudinal axis of a club shaft is made longer, so that an axial moment of inertia about the shaft is greater. The golf club heads have advantageous effects that owing to great axial moment of inertia about the shaft, their ball-striking faces can be impacted against a ball without deviating upon swinging, and even when a ball is hit with a spot outside a sweet spot, the directional behavior and driving distance of the struck ball are improved.

14 Claims, 3 Drawing Sheets

GOLF CLUB HEADS

This application is a continuation of application Ser. No. 552,628 filed Jul. 16, 1990 now abandoned.

FIELD OF THE INVENTION

The present invention relates to golf club heads (hereinafter may called simply "heads"). More specifically, this invention is concerned with golf club heads in which axial moment of inertia about club shafts is made greater, so that it is possible to prevent their club faces from deviating in the course of swinging motion and at a moment of their impact against a ball, and the directional behavior and driving distance of the struck ball are hence improved to a significant extent .

BACKGROUND OF THE INVENTION

In conventional heads, for example, a wooden head, the point of gravity center is positioned in the vicinity of the longitudinal axis of its club shaft. This results in a structure that its axial moment of inertia about the shaft is small and the head is hence liable to rotate about the axis of the shaft.

Accordingly, when a right-hander swings the wood, the right hand is used to an extent equal to or greater than the left hand, whereby the club is slightly rotated by force of the right hand, in particular, as a phenomenon often observed among beginners. As a result, the club face (ball-striking face) has become a so-called closed face in which-the ball-striking face is directed to the left against a direction of a target at a moment of its impact against a ball, so that the directional behavior of the ball struck has been disordered. On the other hand, an attention is paid to a head part upon striking a ball. When the ball is hit with a spot outside a sweet spot of the head, the club face (ball-striking face) is liable to deviate, so that the directional behavior and driving distance of the struck ball are impaired.

OBJECTS AND SUMMARY OF THE INVENTION

An object of this invention is to solve the above-mentioned drawbacks attributable to the structure of the conventional golf club heads so as to provide a golf club in which a ball-striking face a little deviates in the course of swinging motion, and even when a ball is hit with a spot outside a sweet spot of the ball-striking face, the directional behavior and driving distance of the struck ball are improved.

In brief, this invention is directed to a golf club head in an aspect thereof. The head comprises a ball-striking face, a toe, a sole, a heel and a neck, and is characterized in that the point of gravity center of the head is positioned on the rear side of the ball-striking face, and a plane ($S_1$) perpendicular to the ball-striking face, in which plane the longitudinal axis of a club shaft lies, is maintained in the following relation.

Namely, the plane ($S_1$) perpendicular to the ball-striking face, in which plane the longitudinal axis of the club shaft lies, is defined in the following manner:

(i) the plane does not intersect with the ball-striking face; and (ii) supposing a plane extending through an edge of the ball-striking face, said edge being close to the axis of the shaft, and parallel to the plane ($S_1$) is ($S_2$), a distance between the plane ($S_1$) and the plane ($S_2$) is designed to a desired interval.

By fulfill the above requirements, a head according to this invention is allowed to make a distance between the point of gravity center of the head and the longitudinal axis of the shaft longer, so that axial moment of inertia about the shaft can be increased.

DETAILED DESCRIPTION OF THE INVENTION

Figure 1:
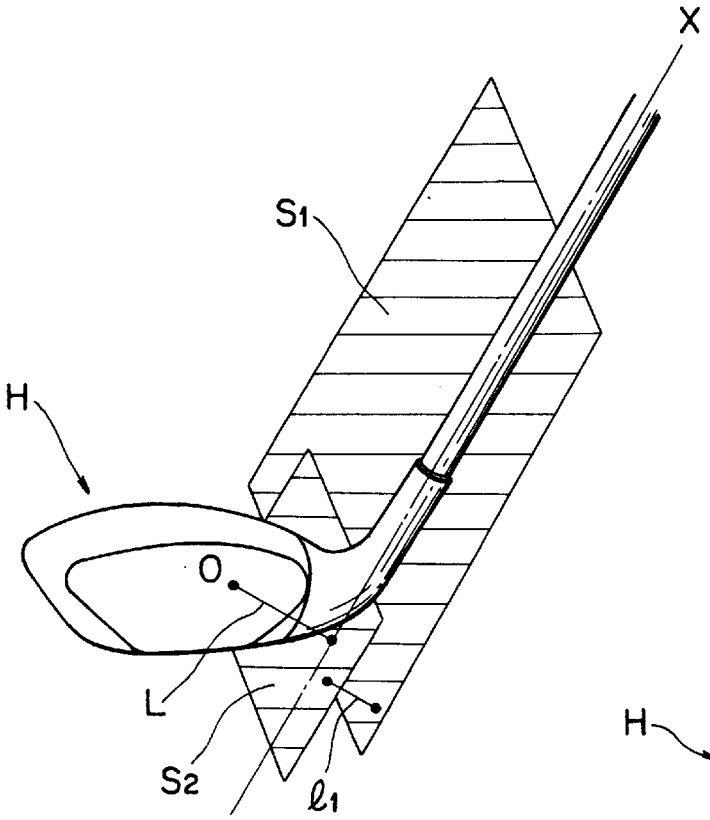
FIG. 1 illustrates a structure of a head according to this invention.

This invention will hereinafter be described in detail.

Now, features and embodiments of this invention will be described on the basis of the accompanying drawings. However, it should be borne in mind that this invention is not limited to those illustrated in the drawings.

FIG. 1 illustrates a structure of a typical head according to this invention. Namely, FIG. 1 illustrates the structure of a head in which a distance between the point of gravity center (O) of the head (H) and the longitudinal axis (X) of a club shaft is increased. In FIG. 1, a plane ($S_1$) is perpendicular to a ball-striking face (1) of the head (H) and extends through the longitudinal axis (X) of the shaft, while a plane ($S_2$) extends through an edge of the ball-striking face (1), which is close to the axis of the shaft, and is parallel to the plane ($S_1$). The planes ($S_1$) and ($S_2$) are situated so as to separate by a desired distance ($l_1$) from each other. Such a situation allows to ensure elongating the distance (L) between the point of gravity center (O) of the head (H) and the longitudinal axis (X) of the shaft. In this invention, $l_1$ is preferably 5 mm or more, but is not limited to such an interval.

Figure 2:
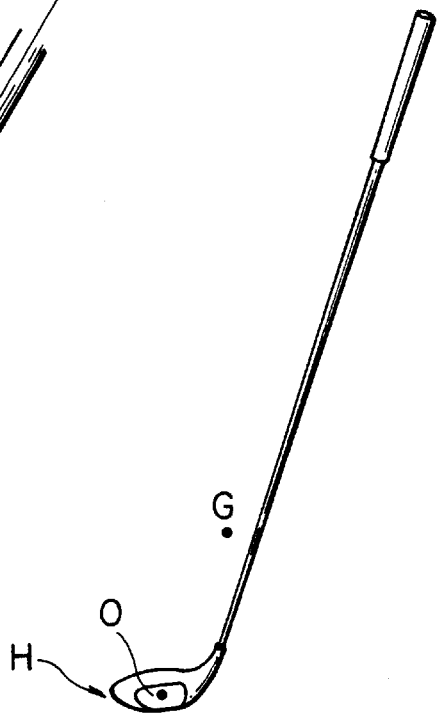
FIG. 2 is a perspective view of a whole golf club having a head according to this invention.

FIG. 2 is a perspective view of a whole golf club having a head according to this invention. It is understood from FIG. 2 that the point of gravity center of a conventional golf club having a wooden head is positioned in the vicinity of the longitudinal axis of its shaft, while the point of gravity center (G) of the golf club having the head according to this invention is shifted remote from the longitudinal axis of the shaft. Namely, the point of gravity center (G) of the whole club is positioned in front of the upper portion of the shaft.

In the golf club having the head according to this invention, which is illustrated in FIG. 2, the point of gravity center (G) of the club is separated from the axis of the shaft. Therefore, the path of the swinging motion of the golf club becomes stable owing to the relation between the point of application of force and the center of gravity. This is attributed to the fact that when an object is moved, its moving path is more stable upon pulling it rather than pushing it. In the case of this invention, the distance (L) from the longitudinal axis (X) of the shaft to the point of gravity center (O) of the head is longer. Therefore, a distance from the longitudinal axis (X) of the shaft to the point of gravity center (G) of the whole club also becomes longer, so that the path of swinging motion upon swinging is stable.

Figure 3:
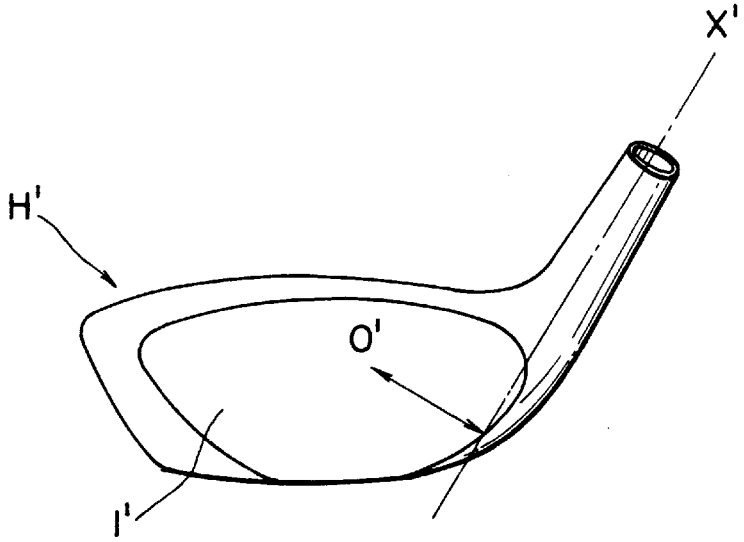
FIG. 3 (PRIOR ART)
FIG. 3 is a perspective view of a conventional golf club head.

FIG. 3 is a perspective view of a conventional golf club head (H') and shows the fact that the longitudinal axis (X') of its shaft intersects with its ball-striking face (1') and a distance between the point of gravity center (O') of the head and the longitudinal axis (X') of the shaft is short.

ADVANTAGES OF THE INVENTION

The golf club head according to this invention can exhibit the following excellent advantageous effects.

(i) owing to great axial moment of inertia about the shaft, the head is hard to rotate about the axis of the shaft even when using, for example, the right hand powerfully. Therefore, the ball-striking face can be impacted against a ball without its deviation, so that the directional behavior and driving distance of the struck ball can be improved.

(ii) Owing to great moment of inertia about the gravity center of the head, even when a ball is hit with a spot outside a sweet spot, the ball-striking face does not deviate and the directional behavior of the struck ball is hence improved.

(iii) owing to the long distance from its neck to the front end of the head, the head looks like a larger head upon addressing a ball. It is hence possible to swing the club feeling easy.

(iv) The path of swinging motion upon swinging the golf club becomes more stable owing to the relation between the point of application of force and the center of gravity as the point of gravity center of the whole golf club is separated from the axis of the shaft. In the case of this invention, the distance from the longitudinal axis of the shaft to the point of gravity center of the head is longer. Therefore, a distance from the longitudinal axis of the shaft to the point of gravity center of the whole club also becomes longer, so that the path of swinging motion upon swinging is stable.

(v) Since the distance from the axis of the shaft to the point of gravity center of the head is long, a distance from the axis of the shaft to the ball-striking point of the head also becomes longer. Accordingly, a distance from a grip end to the ball-striking point and a radius of the path drawn by swinging of the golf club also become longer, so that a head speed of the club is increased and a driving distance is hence increased.

(vi) Since a sole is designed so as not to position on the extension line of the axis of the shaft, striking the ground instead of hitting a ball by swinging the club, so-called duffing, can be made less.

(vii) Since a recess is defined on the lower side of the neck, it is possible to provide a golf club capable of suitably adapting to a variety of lie angles upon address of individual players.

ADDITIONAL EMBODIMENTS OF THE INVENTION

Additional embodiments of this invention will hereinafter be described in detail.

Example 1

Figure 4:
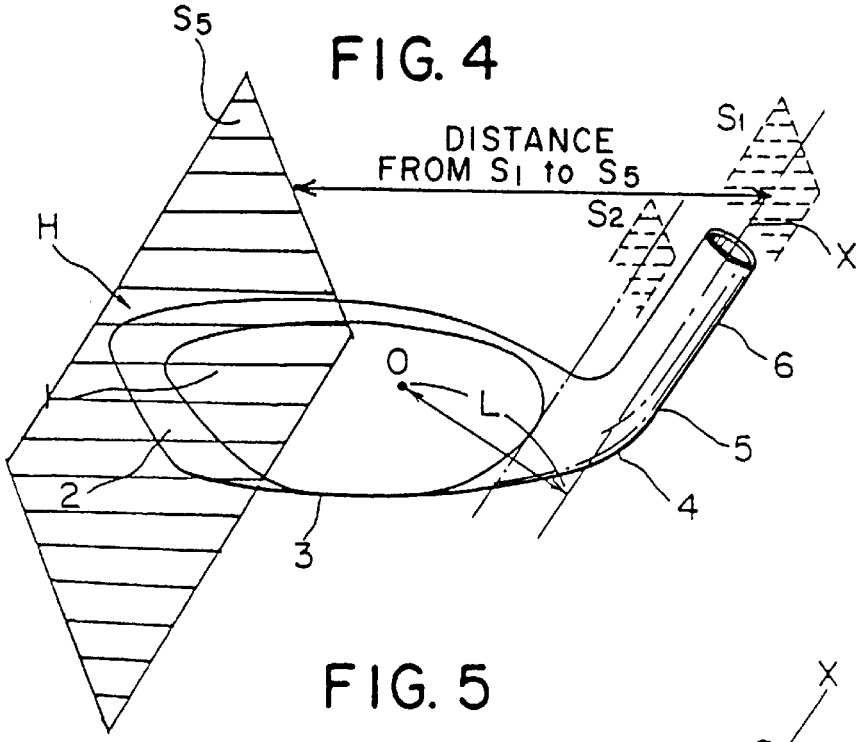
FIGS. 4, 5, 6, 7 and 8 illustrate golf club heads according to first, second, third, fourth and fifth embodiments of this invention, respectively.

A head according to a first embodiment of this invention is depicted in FIG. 4.

The head (H) comprises a ball-striking face (1), a toe (2), a sole (3), a heel (4), a lower neck part (5) and an upper neck part (6). The lower neck part (5) extends obliquely and upwardly from the heel (4). This allows to make a distance from the longitudinal axis (X) of a club shaft to the point of gravity center (O) of the head longer. As illustrated in FIG. 4 and will be described in other embodiments set forth below, in the structure of each head according to this invention, the sole (3) is present apart from on the extension line of the longitudinal axis (X) of the shaft. Therefore, striking the ground instead of hitting a ball by swinging the club, so-called duffing, can be made less.

Example 2

Figure 5:
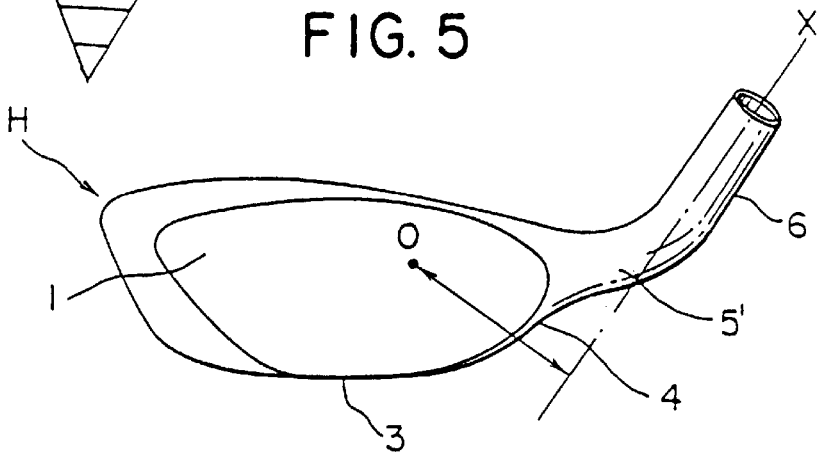

A head according to a second embodiment of this invention is illustrated in FIG. 5.

In the case of this head, a neck is caused to project from the upper part of a heel (4). By forming the neck into a projecting neck (5'), the thickness of the lower portion of the neck is decreased, whereby a recess is defined at this portion. This recess allows to provide a variety of lie angles, which are suitable for individual players upon addressing. In addition, as illustrated in FIG. 5, the projection angle of the neck (5') projecting from the head (H) is narrower than each lie angle. Therefore, the weight of the neck can be made lighter compared with a conventional head wide in projection angle of the neck.

Needless to say, upon projecting the neck from the heel in this invention, the neck may be either simply projected obliquely and upwardly as illustrated in FIG. 4 or projected so as to provide a curved portion in the projecting part as depicted in FIG. 5.

In the above-described manner, a distance (L) from the point of gravity center (O) of the head to the longitudinal axis (X) of the shaft can be made longer. In this invention, it is desirable that the distance (L) should be 35 mm or more, though moment of inertia becomes greater as a distance from the axis of the shaft to the center of gravity is long as given in Table 1 which will be shown subsequently.

Example 3

Figure 6:
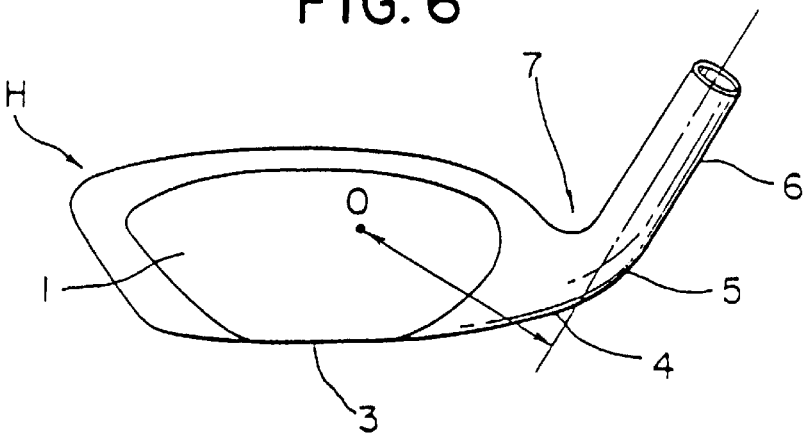

A head according to a third embodiment of this invention is depicted in FIG. 6.

The head in this embodiment is formed at almost the same curvature from a sole (3) to a lower neck (5) through a heel (4). In addition, a feature of the head resides in that a recess (7) is defined on the upper side of the lower neck part (5). Needless to say, the recess (7) may be provided on the lower side of the lower neck part (5) in this invention.

In the case of this embodiment, the above-described recess (7) allows to prevent the point of gravity center from moving toward the heel, so that a head long in distance (L) between the longitudinal axis of the shaft and the point of gravity center can be provided. Moreover, in the case of this embodiment, the head has a configuration in which the lower neck part (5) projects from the rear end of the head (H) (however, how to project the lower neck part (5) is different from that in Example 2). Therefore, the lower neck part (5) is positioned nearly in the direction of the perpendicular of the point of gravity center (O) of the head to the longitudinal axis of the shaft compared to those in Examples 1–2, so that it is possible to prevent the point of gravity center (O) of the head from moving upward (formation of a low gravity-center head). In addition, the recess (7) defined in the head prevents the weight increase of the heel, thereby providing a head light in weight and long in distance from the point of gravity center (O) of the head to the longitudinal axis (X) of the shaft.

In Examples 1–3, axial moment of inertia about the shaft and moment of inertia about the gravity center of the head were measured. As a result, measurements shown in the following Table 1 could be obtained.

Conventional heads have an axial moment of inertia about the shaft of about 4000 and a moment of inertia about the gravity center of about 2000. It is hence understood from the table that the heads according to this invention are superior. By the way, their units are gm-cm$^2$.

TABLE 1

| Example | 1 | 2 | 3 |
|---|---|---|---|
| Axial moment of inertia about the shaft | 5870 | 5638 | 6970 |
| Moment of inertia about the gravity center of head | 2800 | 3369 | 2950 |
| Distance from the longitudinal axis of the shaft to the point of gravity center of head (mm) | 40 | 40 | 45 |

Example 4

Figure 7:
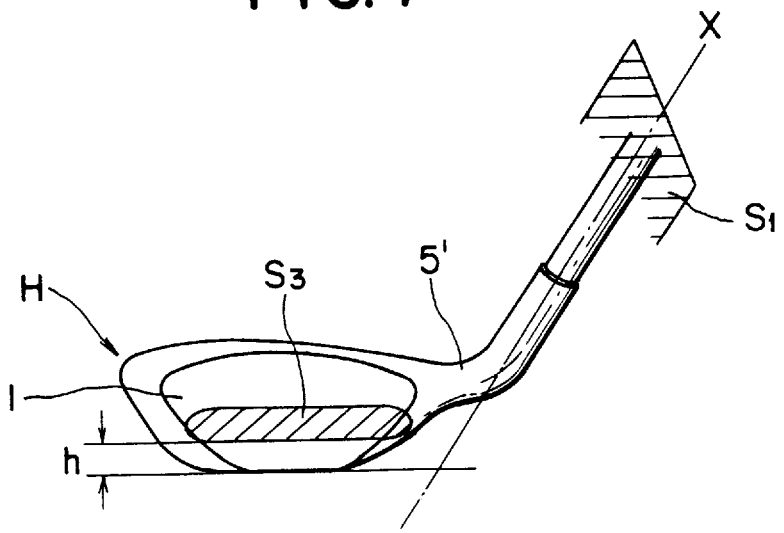

A head according to a fourth embodiment of this invention is illustrated in FIG. 7. The head of this embodiment has a projecting neck (5') like that in Example 2. However, the head is defined in the following manner.

The configurations of club heads are established by code, on the basis of which the length and width of a club head are determined by soling the head in normal position of addressing and measuring horizontally intervals between longitudinal and lateral both ends as to its plane of vertical projection. When the tip on the side of the heel cannot be exactly judged, their dimensions are determined from a cutting plane ($S_3$) horizontally crossing the portion higher than the sole by 16 mm (0.625 inch) (in FIG. 7, designated by "h").

If the club head of this embodiment is defined with the above-described structural arrangement, its cutting plane ($S_3$), bounded by the toe and heel of the club head, horizontally crossing the portion higher than the sole by 16 mm does not intersect with the plane ($S_1$).

Example 5

Figure 8:
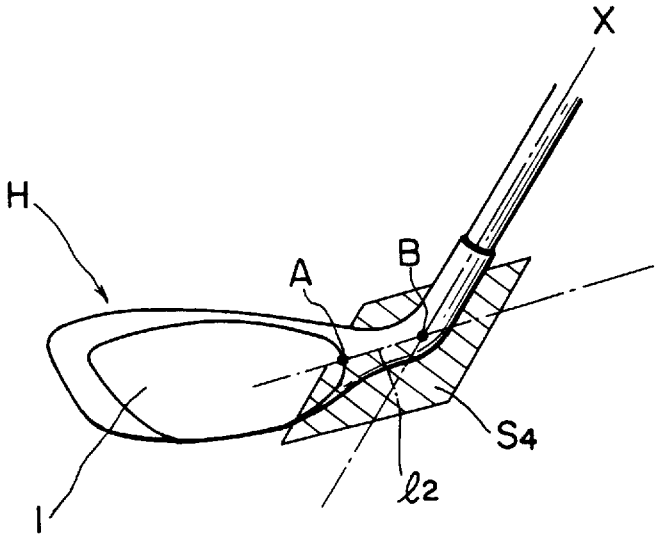

A head according to a fifth embodiment of this invention is depicted in FIG. 8.

The head of this embodiment has a projecting neck (5') like that in Example 2. However, the head is defined in the following manner. Namely, with respect to intersecting points (A and B) of a plane ($S_4$) perpendicular to a ball-striking face (1), in which plane the center line of the projecting neck (5') lies, with the longitudinal axis of the shaft and with the ball-striking face (1) , a distance ($l_2$) between the intersecting points (A and B) is kept to a desired interval. Incidentally, it is needless to say that if the projecting neck (5') in this invention is curved, the surface extending through its center line is naturally a curved surface. In this invention, the distance ($l_2$) is preferably 5 mm or more, but is not limited thereto.

The present invention has been described above by examples where this invention is applied to No. 1 wood. In this case, from the respect of a distance between the plane ($S_1$) extending through the longitudinal axis of the shaft and the plane ($S_5$) abutting on the toe of the head and parallel to the plane ($S_1$), this distance is preferably 85 mm or more, but is not limited thereto. However, the present invention is not limited to heads of No. 1 wood only, but can also be applied to heads for higher-numbered woods whose heads are smaller in configurations or to various irons in the same constitution with respect to positional relation between the longitudinal axis of the shaft and the ball-striking face.

While the invention has been particularly shown and described in reference to preferred embodiments thereof, it will be understood by those skilled in the art that changes in form and details may be made therein without departing from the spirit and scope of the invention.

I claim:

1. A wood type golf club head comprising:

a toe located at a front of said head;

a sole located at a bottom of said head;

a heel located at a rear of said head;

a ball-striking face located in a central position of said head between said toe and said heel, said ball-striking face having front and rear sides; and a neck leading from said heel to a shaft of a golf club to which said head is to be connected, wherein a point, at which a center of gravity of said head is located, is positioned on said rear side of said ball-striking face, and a length of an imaginary perpendicular line which is drawn from said point at which said center of gravity of said head is located to a longitudinal axis of said shaft of said golf club to which said head is connected, is at least 35 mm.

2. The wood type golf club head according to claim 1, wherein a distance between a plane S1, which is perpendicular to said ball-striking face and which extends along said longitudinal axis of said shaft of said golf club to which said head is connected, and a plane S2, which extends through an edge of said ball-striking face, is at least 5 mm so that an edge, which is close to said longitudinal axis of said shaft of said golf club to which said head is connected and which is parallel to said plane S1, is limited by a distance from said longitudinal axis of said shaft of said golf club to which said head is connected, and said sole is not positioned on an extension of said longitudinal axis of said shaft of said golf club to which said head is connected.

3. The wood type golf club head according to claim 1, wherein a portion of said neck, which is bent and which projects to said heel, is provided on said heel, and a projecting angle of said neck is smaller than a lie angle of said head.

4. The wood type golf club head according to claim 2, wherein a portion of said neck, which is bent and which projects to said heel, is provided on said heel, and a projecting angle of said neck is smaller than a lie angle of said head.

5. The wood type golf club head according to claim 2, wherein a cutting plane S3, which is encompassed by said toe and said heel of said head of said golf club and which horizontally crosses at a position having a height of at least 16 mm from said sole, is perpendicular to said ball-striking face and does not intersect said plane S1, which is perpendicular to said ball-striking face and which extends along said longitudinal axis of said shaft of said golf club to which said head is connected.

6. The wood type golf club head according to claim 1, wherein a distance between intersecting points of any one of a plane and a curved surface S4, which is perpendicular to said ball-striking face and which passes through a center line of said neck with said longitudinal axis of said shaft of said golf club to which said head is connected, and with said ball-striking face, is at least 5 mm.

7. The wood type golf club head according to claim 1, wherein a recess is defined at any one of an upper and lower part of said neck.

8. The wood type golf club head according to claim 3, wherein a recess is defined at any one of an upper and lower part of said neck.

9. The wood type golf club head according to claim 4, wherein a recess is defined at any one of an upper and lower part of said neck.

10. The wood type golf club head according to claim 2, wherein a distance between said plane S1 and a plane S5, which touches said toe of said head and which is parallel to said plane S1, is at least 85 mm.

11. The wood type golf club head according to claim 4, wherein a distance between said plane S1 and a plane S5, which touches said toe of said head and which is parallel to said plane S1, is at least 85 mm.

12. The wood type golf club head according to claim 5, wherein a distance between said plane S1 and a plane S5, which touches said toe of said head and which is parallel to said plane S1, is at least 85 mm.

13. The wood type golf club head according to claim 8, wherein a distance between said plane S1 and a plane S5, which touches said toe of said head and which is parallel to said plane S1, is at least 85 mm.

14. The wood type golf club head according to claim 9, wherein a distance between said plane S1 and a plane S5, which touches said toe of said head and which is parallel to said plane S1, is at least 85 mm.

* * * * *